United States Patent [19]

Glascock, Jr.

[11] 4,117,378

[45] Sep. 26, 1978

[54] REFLECTIVE COATING FOR EXTERNAL CORE ELECTRODELESS FLUORESCENT LAMP

[75] Inventor: Homer H. Glascock, Jr., Scotia, N.Y.

[73] Assignee: General Electric Company, Schenectady, N.Y.

[21] Appl. No.: 776,588

[22] Filed: Mar. 11, 1977

[51] Int. Cl.[2] ..... H05B 41/16; H05B 41/24

[52] U.S. Cl. ..... 315/248; 313/116; 315/39; 315/344

[58] Field of Search ..... 315/248, 344, 39; 313/113, 116, 488

[56] References Cited

U.S. PATENT DOCUMENTS

| | | | |
|---|---|---|---|
| 3,225,241 | 12/1965 | Spencer et al. | 313/488 |
| 3,521,120 | 7/1970 | Anderson | 315/248 X |
| 3,987,331 | 10/1976 | Schreurs | 313/113 |

*Primary Examiner*—Saxfield Chatmon, Jr.

*Attorney, Agent, or Firm*—Lawrence D. Cutter; Joseph T. Cohen; Marvin Snyder

[57] ABSTRACT

The header and tunnel of an external core, solenoidal electric field, fluorescent lamp are coated with a thin ultraviolet light-reflective layer; for example, aluminum or magnesium oxide. Radiative heat transfer from the lamp plasma to the magnetic core is thus reduced to permit high operating power levels and good lumen maintenance.

10 Claims, 2 Drawing Figures

REFLECTIVE COATING FOR EXTERNAL CORE ELECTRODELESS FLUORESCENT LAMP

This invention relates to electrodeless fluorescent lamps. More specifically, this invention relates to reflective coatings which increase the maximum operating power and lumen maintenance characteristics of external core, solenoidal electric field, fluorescent lamps.

BACKGROUND OF THE INVENTION

U.S. Pat. No. 4,005,330 to John M. Anderson and Homer H. Glascock, Jr. describes induction ionized fluorescent lamps wherein a solenoidal electric field is produced by induction through an annular magnetic core which is external to, yet centrally disposed within, a substantially globular lamp envelope. The magnetic core passes through a channel in the lamp envelope to link a working gas there-within. Fluorescent lamps constructed in accordance with the teachings of that patent may be physically and electrically compatible with screw-base incandescent lamps, yet provide operating efficiencies comparable to those of conventional fluorescent lamps. The specification of U.S. Pat. No. 4,005,330 is incorporated herein by reference, as background material for this invention.

The maximum operating power level usable in solenoidal electric field, fluorescent lamps has been found to be limited by the thermal characteristics of the magnetic cores, which are typically ferrites. Saturation magnetic flux density in conventional ferrite cores has, for example, been found to decrease rapidly as the core temperature approaches a limit of approximately 125° C. Magnetic losses within the ferrite also tend to increase with increased temperature. Thus, for a lamp of given physical dimensions, ferrite temperature effectively determines the maximum permissible operating power level. It is, thus, important to keep ferrite temperatures from reaching too high a value.

The regions of the envelope directly adjacent the magnetic core in the lamps of U.S. Pat. No. 4,005,330, that is, the header and tunnel regions, are typically coated with ultraviolet-to-visible light converting phosphors of the type which are normally utilized in conventional fluorescent lamps. The ultraviolet flux density and temperature at the header and tunnel regions is generally considerably higher than at other portions of the lamp envelope; a condition which tends to result in poor lumen maintenance for phosphors deposited in those regions.

SUMMARY OF THE INVENTION

I have determined that a substantial part of the heat transferred to the ferrite cores of external core, solenoidal electric field, fluorescent lamps is delivered by radiation from the gas discharge. The operating temperature of ferrite cores in such lamps may be substantially reduced by coating the header and tunnel regions of the envelope with an ultraviolet-radiation-reflective coating, in place of the phosphor layers normally utilized in those regions. The reflective coatings also tend to redistribute ultraviolet radiation which is incident on the header and tunnel to a larger and somewhat cooler area of the outer lamp envelope to thus reduce the lumen maintenance limitations which were encountered in previous lamp constructions. Thin coatings of aluminum or magnesium oxide are suitable reflectors.

It is, therefore, an object of this invention to permit the operation of solenoidal electric field, fluorescent lamps at higher power levels than would otherwise be possible.

Another object of this invention is to reduce the cost of cooling the ferrite in a solenoidal electric field, fluorescent lamp.

Another object of this invention is to increase the lumen maintenance characteristics of solenoidal electric field, fluorescent lamps.

BRIEF DESCRIPTION OF THE DRAWINGS

The novel features believed characteristic of the present invention are set forth in the appended claims. The invention itself, together with further objects and advantages thereof, may best be understood by reference to the following detailed description, taken in connection with the appended drawings in which:

DESCRIPTION OF THE PREFERRED EMBODIMENTS

Figure 1:
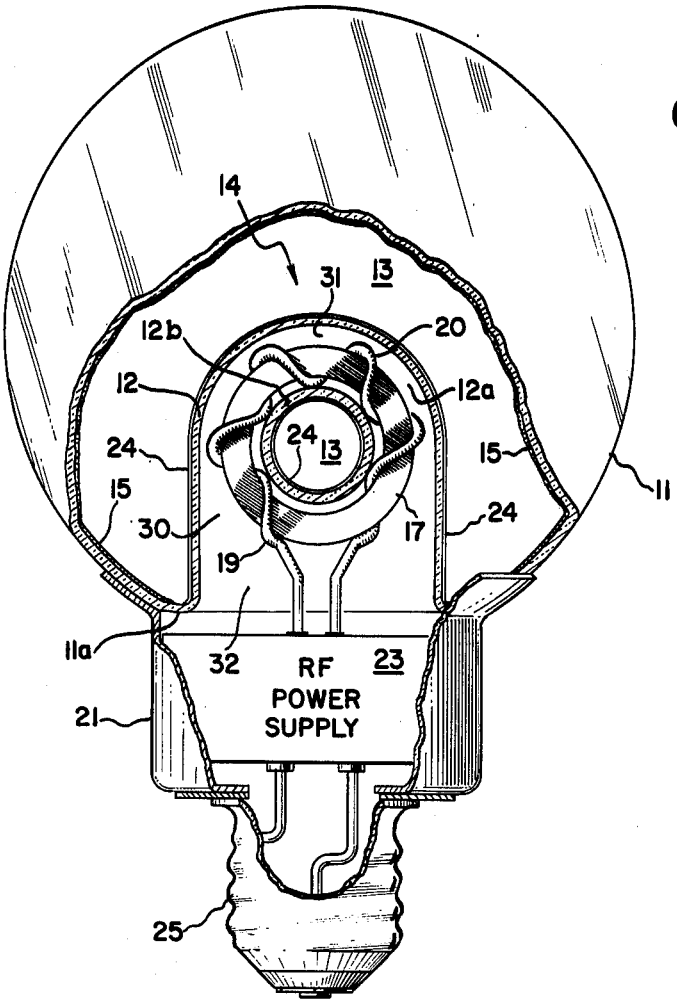
FIG. 1 is a solenoidal electric field, fluorescent lamp of the present invention.

FIG. 1 is a solenoidal electric field, fluorescent lamp having a substantially globular, light-transmissive envelope 11, which may for example, comprise glass. A header assembly 14 comprises a capsule 12 which inwardly extends from a flattened base portion **11*a* of the envelope 11 to define a semi-obround reentrant cavity 12*a*, which may, for example have a substantially rectangular cross section. A cylindrical dielectric tunnel 12*b* traverses the capsule 12 along its axis. The strucure of the capsule 12 and the tunnel 12*b* therefore define a channel 31** of substantially rectangular cross section. The structure of the header and tunnel is more clearly illustrated in FIG. 2.

The envelope 11 and the tunnel **12*b* contain an ionizable gas 13, for example, a mixture of rare gas (e.g., krypton and/or argon) with mercury vapor and/or cadmium vapor, of the type which emits radiation upon electrical excitation. The interior surfaces of the envelope 11 are coated with a fluorescent lamp phosphor 15, which may be of any type known to the lamp art; these phosphors are capable of absorbing ultraviolet radiation from the gas 13** and, when excited thereby, emitting visible light.

A closed loop, magnetic core 17, advantageously of toroidal shape, lies within the capsule 12 encircling the tunnel **12*b*. To insure efficient operation, the core is preferably of a high permeability, low-loss type, more fully described in the referenced patent. A multi-turn primary winding 19, which may, for example, be insulated with a glass fiber fabric 20 is wrapped onto the core 17 and lies within the header 14**.

Radio frequency electric current flowing within the primary winding 19 excites a radio frequency magnetic field within the core 17. The magnetic field induces a solenoidal electric field in the ionizable gas 13, within the envelope 11 and the tunnel **12*b***. The electric field ionizes the gas, stimulating radiation and visible light output. In this embodiment of the invention, the ionized gas is not relied upon to produce substantial visible light emission, but rather to produce radiation which causes light to be emitted from a fluorescent phosphor. As is well known in the art, this allows for a relatively efficient power utilization.

As indicated in the referenced patents, ferrite or similar core materials are suitable to provide high permeability and low internal heat loss at the operating frequency. The permeability of ferrite is known to decrease, however, and core losses are known to increase during high temperature operation. In operation, the ionized gas forms a plasma surrounding the transformer core.

A cylindrical base structure 21 attached to the envelope base part 11*a*, contains a radio frequency power supply 23 which is connected to provide a radio frequency current through the primary winding 19. A lamp base plug 25 is attached to the base structure 21 opposite the envelope 11 and is adapted to receive power line energy from conventional sockets.

Figure 2:
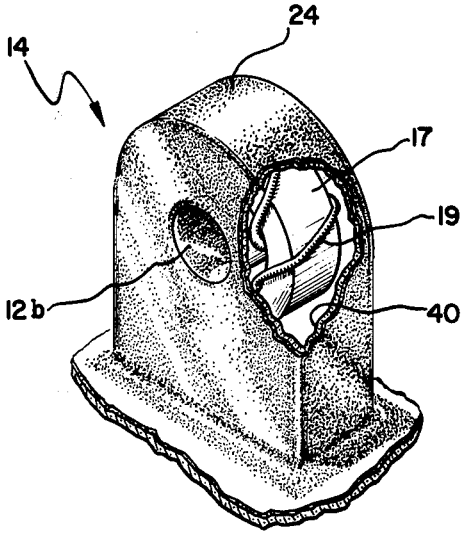
FIG. 2 is an enlarged view of the tunnel and header of the lamp of FIG. 1.

The transformer core header and tunnel structures are more fully detailed in FIG. 2 wherein the transformer core 17 may be seen to surround the tunnel 12*b*. The core 17 and winding 19 lie outside the gas 13 but are centrally located within the envelope structure. The central core location provides a plasma which fills and illuminates the envelope providing a pleasing and uniform light output. The transformer core 17 and the windings 19 lie outside the envelope, at atmospheric pressure, which facilitates heat transfer from the core and eliminates outgassing effects with associated contamination of the gas and phosphors. Alternatively, the space 30 within the capsule 12 may be filled with a heat transfer medium or resin (not shown) to improve heat transfer from the core, if desired.

The header 14 and tunnel 12*b* surfaces of prior art external core, solenoidal electric field lamps were coated with the same phosphor composition as the interior surfaces of the envelope 11. In such lamps, a substantial part of the electrical power delivered to the plasma ultimately arrives at the header and tunnel assemblies in the form of radiation. Unless this power is re-radiated, reflected, or conducted away, it causes the temperature of the header and tunnel to increase. Since the ferrite core 17 is largely surrounded by the header, its temperature will also rise producing a corresponding reduction in the saturation magnetic flux density of the core ferrite and an increase in its volume power dissipation. As a result, lamp efficacy goes down and if the temperature rise is severe, the lamp may be extinguished. Decreased saturation flux density may, also, produce difficult starting under hot conditions.

In a typical lamp, approximately 60 percent of the plasma input power is delivered to the header and tunnel by the discharge in the form of ultraviolet radiation. A typical phosphor converts only approximately one-third of this radiation into useful light; two-thirds of the radiation heats the lamp structures.

In accordance with the present invention, a thin ultraviolet-radiation-reflective coating 24 is disposed on the surface of the header 14 and the tunnel 12*b*. Ultraviolet radiation incident on these structures is, therefore, reflected to the outer surfaces of the envelope 11 and does not contribute to ferrite heating. The coating 24 may, for example, be a thin layer of aluminum which has been found to reflect approximately 90 percent of incident ultraviolet radiation. Coatings of magnesium oxide have been found to be superior to aluminum.

In the lamps of the present invention, the header and tunnel surfaces do not contribute directly to light output from the lamp. However, much of the ultraviolet radiation reflected from the header ultimately impinges on the phosphor 15 on the envelope 11 outer surfaces and thus gives rise to additional light output. The phosphor on the envelope surface normally operates at a much lower temperature than the header surface and is, therefore, less subject to aging and degradation than were prior art phosphors on the header surface.

Reflective coatings of the present invention allow substantially reduced ferrite core temperatures in external core induction ionized fluorescent lamps and thus permit operation of lamps at higher input power and with better lumen maintenance than did prior art phosphor coated headers.

While the invention has been described in detail herein in accordance with certain preferred embodiments, many modifications and changes may be effected by those skilled in the art. Accordingly, it is intended by the appended claims to cover all such modifications and changes as fall within the true spirit and scope of the invention.

The invention claimed is:

1. In a solenoidal electric field, fluorescent lamp comprising an evacuable, light-transmissive, substantially globular envelope having a channel; a gaseous medium within said envelope adapted to sustain an electric discharge due to an electric field induced therein, said ionizable medium emitting ultraviolet radiation when sustaining said discharge; a closed loop magnetic core having a central opening and being at least partially contained within said channel whereby said core links said gaseous medium; means for inducing said electric field in said gaseous medium; and luminous phosphors disposed on interior surfaces of said envelope and adapted to emit visible light when excited by said ultraviolet radiation; the improvement comprising:

an ultraviolet-radiation-reflective coating disposed on inner surfaces of said envelope adjacent said magnetic core.

2. The lamp of claim 1 wherein said coating comprises aluminum.

3. The lamp of claim 1 wherein said coating comprises magnesium oxide.

4. The lamp of claim 1 wherein said core comprises ferrite.

5. The lamp of claim 1 wherein said core is linked by a dielectric tunnel, said coating being disposed on surfaces of said tunnel.

6. The lamp of claim 5 wherein said core is surrounded by a dielectric header, said coating being disposed on surfaces of said header.

7. A fluorescent lamp base structure comprising:

a substantially rectangular member defining a cavity having approximately square front and back surfaces, said front and back surfaces each having a centrally located perforation, the bottom surface of said cavity having a substantially rectangular perforation and adapted to allow access to the interior of said cavity;

a tubular dielectric member, having sectional dimensions approximately equal to the dimensions of said perforations, extending between said front surface and said back surface and sealed thereto the edges of said perforations;

a closed loop magnetic core disposed on said tubular member and contained within said cavity; and an ultraviolet reflective coating disposed on surfaces of said dielectric member.

8. The strucute of claim 7 wherein said reflective coating is further disposed on the outer surfaces of said rectangular member.

9. The structure of claim 8 wherein said reflective coating is aluminum.

10. The structure of claim 8 wherein said reflective coating is magnesium oxide.

* * * * *